United States Patent [19]

Richardson

[11] 4,300,183

[45] Nov. 10, 1981

[54] METHOD AND APPARATUS FOR GENERATING ALTERNATING MAGNETIC FIELDS TO PRODUCE HARMONIC SIGNALS FROM A METALLIC STRIP

[76] Inventor: Robert H. Richardson, 8361 Sylvan Dr., Melbourne, Fla. 32901

[21] Appl. No.: 134,684

[22] Filed: Mar. 27, 1980

[51] Int. Cl.[3] ..... H01H 47/32

[52] U.S. Cl. ..... 361/152; 340/572; 361/203

[58] Field of Search ..... 361/152, 191, 203, 180; 340/572

[56] References Cited

U.S. PATENT DOCUMENTS

| | | | |
|---|---|---|---|
| Re. 29,610 | 4/1978 | Minasy et al. | 340/572 |
| 3,665,449 | 5/1972 | Elder et al. | 340/572 |
| 3,758,849 | 9/1973 | Susman et al. | 324/41 |
| 3,820,103 | 6/1974 | Fearon | 340/572 |

*Primary Examiner*—Harry E. Moose, Jr.

[57] ABSTRACT

A system (10) produces an alternating magnetic field in a detection zone between a pair of doorways (346, 348) to produce harmonic signals from a marker (330) when the marker (330) is activated and located in the detection zone. Each of the doorways (346, 348) is provided with a trapezoidally shaped coil which is in a resonant circuit. The coils in the doorways (346, 348) are driven at periodic time periods with in-phase currents to produce aiding magnetic fields perpendicular to doorways in the detection zone. At alternate time periods the coils in the doorways are driven with out-of-phase signals which produce opposing magnetic fields perpendicular to the doorways (346, 348) and aiding magnetic fields parallel to the planes of the doorways. The magnetic fields thus produced in the detection zone cause the marker (330) when activated to produce harmonic signals despite the orientation of the marker (330) as it passes through the detection zone.

11 Claims, 11 Drawing Figures

METHOD AND APPARATUS FOR GENERATING ALTERNATING MAGNETIC FIELDS TO PRODUCE HARMONIC SIGNALS FROM A METALLIC STRIP

TECHNICAL FIELD

The present invention pertains to electromagnetic detection systems and more particularly to a system for detecting a magnetic strip which generates harmonic signals when exposed to an alternating magnetic field.

FIELD OF THE INVENTION

Shoplifting has been a major problem for retail distributors of goods for some time. With products placed on open shelves for easy inspection by customers it is not difficult for a shoplifter to remove a product and leave the store without paying for the merchandise. Numerous systems have been proposed for detecting the theft of merchandise from retail outlets. One particular type of such system is described in U.S. Pat. No. 3,820,104 to Fearon. This system utilizes a magnetic marker that is attached to the merchandise in an inconspicuous location. The marker comprises a low coercivity strip of metal having attached to it a higher coercivity strip of metal.

In the Fearon patent, the higher coercivity material is defined as the control element. When the marker is exposed to an alternating magnetic field and the control element is not magnetized, which is the sensitized state the marker generates signals at harmonic frequencies of the alternating magnetic field. These harmonic signals can be detected to indicate the presence of the marker when it is in the sensitized state. The marker is desensitized by magnetizing the control elements so that the magnetic strip is saturated such that the alternating magnetic field cannot change the magnetization of the strip. In this state the magnetic strip produces few or no harmonic signals and is thus not detectable. The marker is activated while it is attached to merchandise in the store and is deactivated at the point of sale. Customers are routed through a detection gate following the sales terminal so that any merchandise not paid for can be detected. The gate includes the apparatus for generating the alternating magnetic field and for detecting the harmonic signals. Thus any merchandise which is carried through the gate without being desensitized, and therefore paid for, is detected and the shoplifter can be apprehended. The detection gate includes interrogation coils within the body of the gate for generating the alternating magnetic field that causes the magnetic strip to produce the harmonic signals. In applications heretofore, these interrogation coils are configured in a round or square shape. It is, however, a characteristic of the magnetic marker strip that it can be magnetized only when the alternating magnetic field is aligned along its longitudinal axis. Therefore, the magnetic marker must be properly aligned when it is passed through the detection gate in order to be detected. Interrogation coils heretofore have generated only a limited number of differently oriented magnetic fields so that there remain certain orientations through which a sensitized magnetic marker may be transported through the gate without causing detection of the marker. Such a limitation allows a certain portion of stolen merchandise to be transported through the detection gate without recognition and for those shoplifters who can find the marker and realize the significance of the orientation, can easily remove the merchandise without the fear of detection.

Therefore, there exists a need for a detection gate which generates alternating magnetic fields through which it is very difficult to transport a sensitized detection marker without the generation of harmonic signals which can be detected to indicate that tagged merchandise is being removed from the store without payment.

DISCLOSURE OF THE INVENTION

A shoplifting system for preventing theft of tagged merchandise includes apparatus for generating an alternating magnetic field in a detection zone to produce harmonic signals from a metallic strip therein comprises first and second coils of electrically conductive material, each of the coils being configured to have a plurality of essentially linear segments. A first group of the segments has each one thereof oriented at an acute angle relative to horizontal. A second group of the segments has each one thereof oriented essentially vertically. The first and second coils are spaced apart in parallel, vertical planes to form the detection zone therebetween.

Circuitry is provided for producing an alternating current in the first coil and for producing in the second coil an alternating current which alternates between being in-phase and out-of-phase with the current in the first coil.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION OF THE INVENTION

Figure 1:
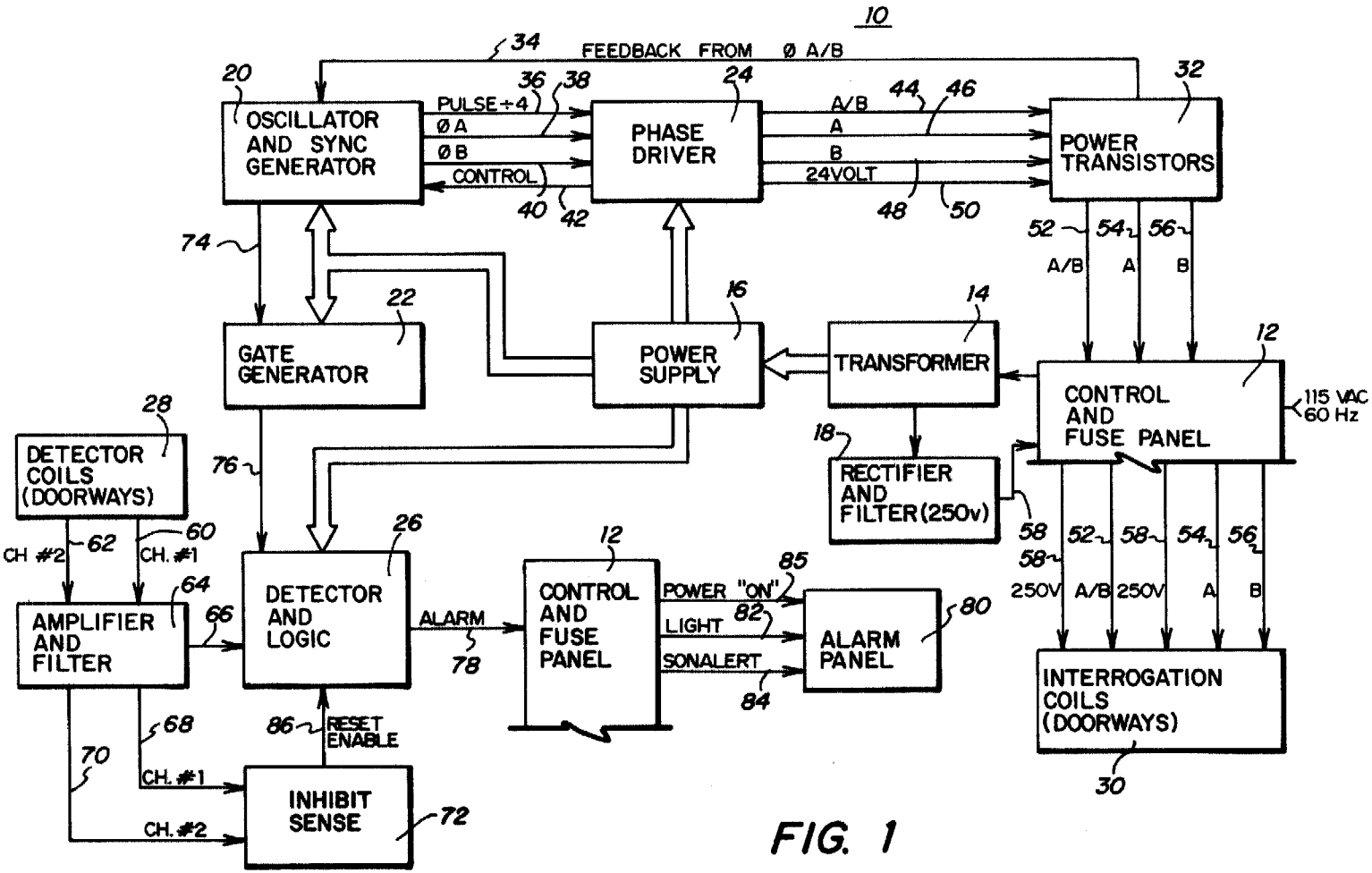
FIG. 1 is a block diagram of a detection system which includes the present invention.

Referring to FIG. 1 there is illustrated a block diagram of a detection system 10 which interrogates a nearby marker to determine whether the marker is in the active or inactive state. The primary application of the system 10 is in the prevention of shoplifting where the marker is activated when attached to merchandise and deactivated following proper accounting and payment for the item being purchased.

Commercial line power is supplied to a control and fuse panel 12 which serves to distribute power and information signals throughout the system 10. Although control and fuse panel 12 is a single entity it is shown in FIG. 1 as having two parts to better show the functional operation of system 10. The line power is transferred through panel 12 to a transformer 14 which distributes the power at various voltage levels to a power supply 16 and to a rectifier and filter 18. A high voltage DC power signal (approximately 250 v.) is generated in the rectifier and filter 18 and transmitted through the panel 12 for use elsewhere in system 10.

Power supply 16 generates a plurality of voltages which are distributed throughout the system 10 for powering various parts thereof. Power is provided by supply 16 to an oscillator and sync generator 20, a gate generator 22, phase driver 24, a detector and logic circuit 26 and other subunits within system 10.

The field of detection for system 10 is defined as the area between a pair of doorway units each of which includes a detector coil and an interrogation coil. The doorway units are further illustrated in FIGS. 9–11. Within system 10 the detector coils are shown with reference numeral 28 and the interrogation coils are shown with reference numeral 30.

Each of the interrogation coils 30 is included within a resonant circuit which oscillates at a frequency of approximately 10 Khz. The resonant circuits which include the interrogation coils 30 are driven by a collection of power transistors 32 through the control and fuse panel 12.

Figure 2:
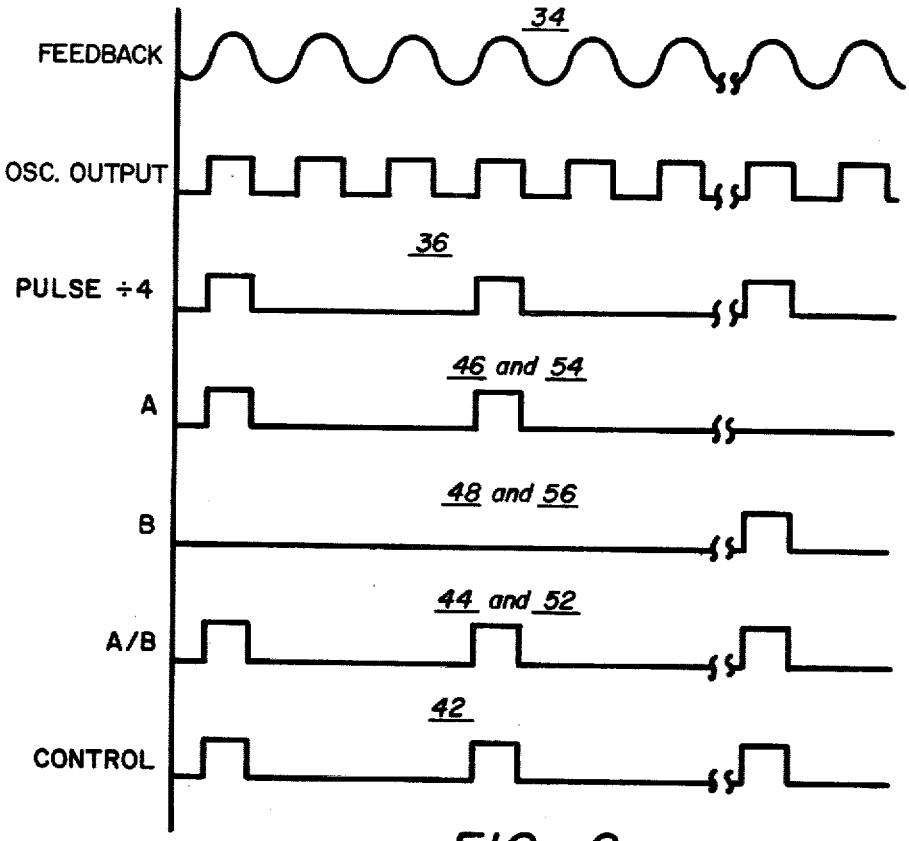
FIGS. 2 and 3 are illustrations of various signals produced in the system shown in FIG. 1.
Figure 3:
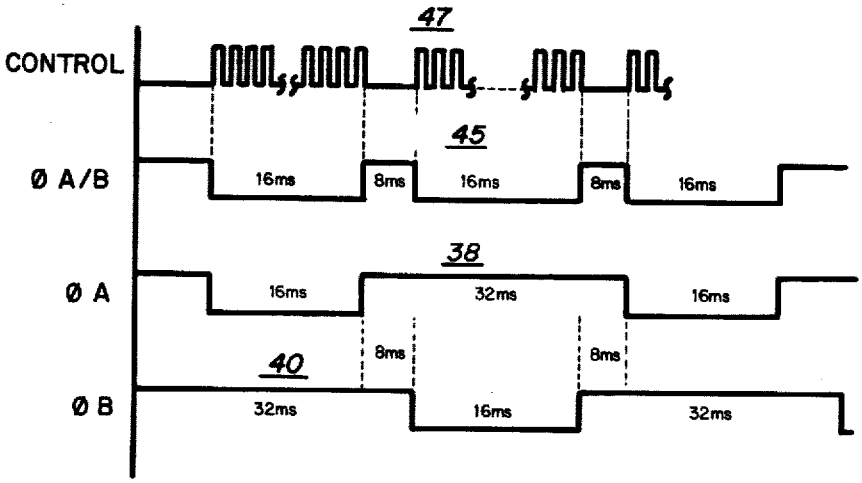

The oscillator and sync generator 20 produces a plurality of control signals which drive the resonant circuits within the interrogation coils and provide timing throughout the system. The oscillator and sync generator 20 receives an oscillatory signal through a feedback path 34 from the power transistor circuit 32. This oscillatory signal comprises the signal produced by a given one of the interrogation coils. From this feedback signal the circuit 20 produces a number of control signals which are illustrated in FIGS. 2 and 3. These control signals include a pulse divide-by-four signal on line 36, a $\phi$ A enable signal on line 38 and a $\phi$ B enable signal on line 40. A control signal is transmitted on line 42 from the phase driver 24 to the oscillator and sync generator 20. Each of the signals on lines 34–42 are illustrated in FIGS. 2 and 3. A $\phi$ A/B signal 45 and a control signal 47 are generated by a control module 192 shown in FIG. 5.

Referring back to FIG. 1 the phase driver 24 receives the three different control signals from the oscillator and sync generator 20 and produces at the output thereof an A/B signal on line 44 and this signal is transmitted to the power transistor circuit 32. The A and B signals are transmitted from the phase driver 24 through lines 46 and 48 respectively to the power transistor circuit 32. A 24 volt power signal is also transmitted from the phase driver 24 through line 50 to the power transistor circuit 32.

Within the power transistor circuit 32 the control signals on lines 44, 46 and 48 are utilized to produce various drive signals which serve to maintain the interrogation coils 30 in resonance with selected phase relationships. An A/B control signal is generated by the power transistor circuit 32 and transmitted on line 52 through the control and fuse panel 12 to the interrogation coils 30. An A signal is transmitted through a line 54 to interrogation coils 30. Likewise a B signal is transmitted through a line 56 to the interrogation coils 30.

As noted above the rectifier and filter 18 produces a 250 volt DC signal on a line 58 and this is transmitted to each of the interrogation coils 30 through the control and fuse panel 12. The interrogation coils 30 are described further below and each is a center tapped coil having the center tap connected to the 250 volt line 58. The various remaining terminals on the coils are connected to control lines 52, 54 and 56. The power transistors 32 provide periodic grounds to the interrogation coils 30 so that current flow is produced through the coils to cause resonance after the ground is removed. The interrogation coils 30 thus produce a magnetic field between the doorways which define the field of detection. The magnetic field produced is described in greater detail below.

Detector system 1 is designed to detect the presence of an activated marker within the field of the detector coil. Such a marker is further described in U.S. Pat. application Ser. No. 943,529 to Robert H. Richardson filed Sept. 18, 1978 and now U.S. Pat. No. 4,222,517. Basically, when the magnetic marker is in the active state the magnetic field produced by the interrogation coils 30 causes the marker to produce harmonic signals which can be detected by the receiving circuits of system 10. The harmonic signals generated by the marker are received by the detector coils 28, one of which is located within each of the doorways of system 10. The received signals from the doorways is transmitted as channel number one signal through line 60 from a first doorway and channel number two signal through line 62 from a second doorway. The received signals for the two channels are transmitted to an amplifier and filter 64 which bandpass filters the signals at the desired harmonic frequency and amplifies the signals to a useable level. The amplified and filtered receive signals are transmitted from the amplifier and filter circuit 64 through a line 66 to the detector and logic circuit 26. The channel one and channel two signals are also transmitted through lines 68 and 70 through an inhibit sense circuit 72.

The oscillator and sync generator 20 produces a receiver synchronization signal which is transmitted through a line 74 to the gate generator 22 which in turn produces a series of gate pulses designed to pass the receive signal and inhibit noise signals. The signal and noise inhibit pulse trains are transmitted through a line 76 from the gate generator 22 to the detector and logic circuit 26. The gate signals open the detector and logic circuit during the time periods when the marker signal would normally be received and act to inhibit the detector and logic circuits 26 when strong noise signals are being produced. Once a signal is detected from a marker an alarm signal is generated and transmitted through line 78 to the control and fuse panel 12. The alarm signal on line 78 is transmitted to an alarm panel 80 as a light alarm on line 82 and a sonalert signal on line 84. A power "on" signal is transmitted on line 85 to panel 80.

The detection system 10 generates an alternating magnetic field between a pair of doorways for detecting the passage of an activated marker between the doorways. When an activated marker is present in the field of detection a harmonic signal will be generated and this signal will be received by the detector coils 28. The receive signal is then processed by amplifier and filter circuit 64 and then transmitted to the detector and logic circuit 26 which operates to separate the signal and noise signals by means of gate signals provided by a gate generator 22. Upon detection of the received signal, the alarm signal is generated on line 78 which produces an audio alert signal at the alarm panel 80 along with a light alarm signal also at panel 80.

The present invention is described in reference to a system having two doorways, however, it is equally applicable to systems having 3, 4, 5 or more doorways. Additional circuitry corresponding to the circuitry described herein is provided for added doorways.

The inhibit sense circuit 72 is provided with the channel 1 and channel 2 receive signal over lines 68 and 70. A further channel is provided for each additional doorway in a detector system. Circuit 72 is provided with a threshold detector which generates a reset enable signal on line 86 when the amplitude of either of the received signals exceeds a predetermined threshold. The purpose of circuit 72 is to detect the presence of large metal objects in the field of detection of system 10. A large metal object, such as a shopping cart, can cause the system to saturate and produce an alarm output even when there is no activated marker in the field of detection. Thus when the receive signals exceed the predetermined threshold the inhibit sense circuit 72 prevents the detector and logic circuit 26 from generating an output alarm signal on line 78.

Figure 4:
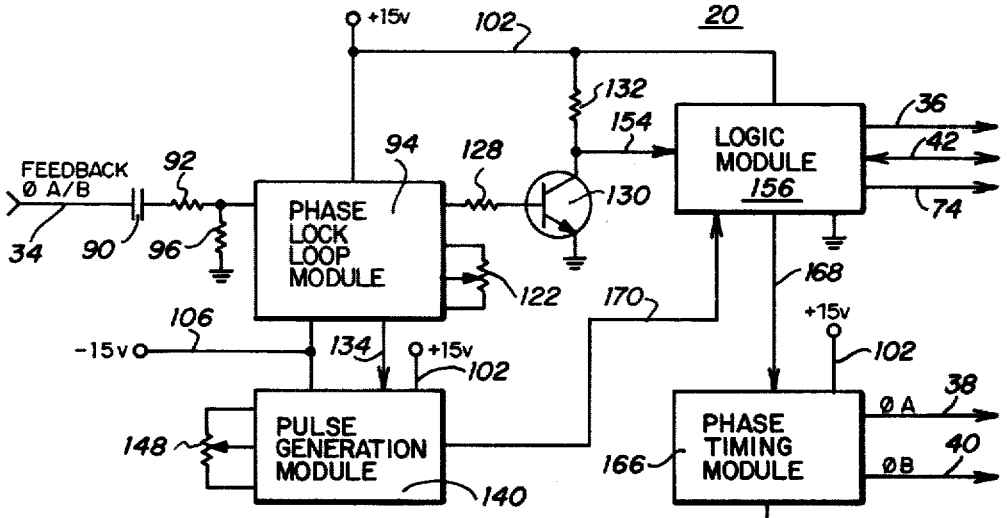
FIG. 4 is a detailed block diagram of the oscillator and sync generator circuit shown in FIG. 1.

The functional units illustrated in FIG. 1 for system 10 are illustrated as schematic diagrams in the following FIGURES to show in detail the operation of these functional units. The oscillator and sync generator 20 is shown in a schematic diagram in FIG. 4. The oscillatory feedback signal from the power transistor circuit 32 is transmitted through a line 34 to an attenuator and filter comprising a series combination of a capacitor 90 and a resistor 92 through a resistor 96 to ground. The junction of resistors 92 and 96 is the input to a phase lock loop module 94. Module 94 is preferably a Model 1120-1565 manufactured by Engineered Assembly. The module is supplied with positive 15 volt power from a bus line 102. A second power line 106 is connected to a negative 15 volt supply. Adjustment of the free-running frequency of the basic oscillator is controlled by a potentiometer 122 connected to the module.

An output of module 94 is connected to a Pulse Generation Module 140 through line 134. The purpose of module 140 is to generate a pulse for each cycle of the oscillations of the interrogation coils. Module 140 is preferably a Model 1120-1311 manufactured by Engineered Assembly. This module is supplied with positive 15 volt power from the bus line 102. The second power bus 106 is connected to a negative 15 volt supply terminal. A potentiometer 148 is connected to module 140 to allow adjustment of the pulse width output that is transmitted to a Logic Module 156 through line 170.

The output of the phase lock loop module 94 is further transmitted through a base resistor 128 to the base terminal of a transistor 130. A collector resistor 132 is connected between the power bus line 102 and the collector terminal of transistor 130. The emitter terminal of transistor 130 is grounded.

The combination of the modules 94 and 140 together with transistor 130 and the associated circuitry form a phase locked pulse circuit which receives the oscillatory feedback signal on line 34 and generates output signal on lines 154 and 170 which are phase locked to the feedback signal from the power transistor circuit 32. These signals are provided as inputs to logic module 156 which comprises a plurality of logic gates and circuits. Module 156 is implemented as Model 1120-1402 and is manufactured by Engineered Assembly. Module 156 is provided with positive 15 volt power through line 102. The control signal from the Phase Driver 24 is received on input line 42 to the Logic Module 156. The pulse divide-by-four signal is output to the Phase Driver 24 on line 36. The gate generator 22 control signal is output by the Logic Module 156 on line 74.

A signal pulse is transmitted to the phase timing module 166 through line 168. The phase timing module 166 receives positive 15 volt power from line 102. The phase timing module 166 is a Model 1120-1000 manufactured by Engineered Assembly.

The $\phi$ A signal produced on line 38 is generated at an output of the phase timing module 166 and the $\phi$ B signal on line 40 is also produced at an output of timing module 166.

Figure 5:
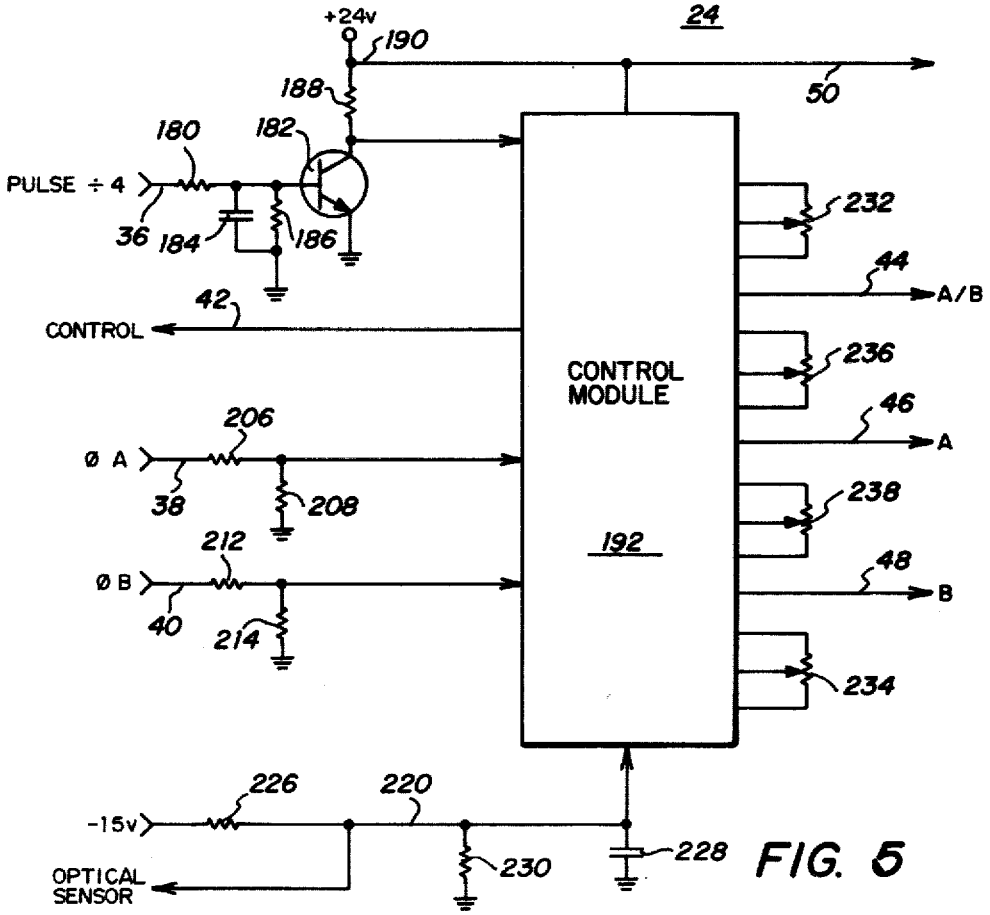
FIG. 5 is a detailed block diagram of the phase driver shown in FIG. 1.

The phase driver 24 shown in FIG. 1 is illustrated in detail in FIG. 5. The pulse divide-by-four signal on line 36 is transmitted through a base resistor 180 to the base terminal of a transistor 182. A parallel combination of a capacitor 184 and a resistor 186 is connected between the base terminal of transistor 182 and ground. The emitter terminal of transistor 182 is grounded. The collector terminal of transistor 182 is connected through a collector resistor 188 to a power bus line 190 which is connected to receive a positive 24 volt supply. The collector terminal of transistor 182 is connected to a control module 192.

The $\phi$ A input line 38 is transmitted to the control module 192 through a resistor divider comprising resistors 206 and 208. The $\phi$ B input on line 40 is transmitted to the control module 192 through the resistor divider comprising resistors 212 and 214.

Positive 24 volt power is supplied to the control module 192 from line 190. The control module is preferably a Model 1120-1001 manufactured by Engineered Assembly.

Line 42 transfers a control signal from the phase driver 24 control module 192 to the oscillator and sync generator 20.

A line 220 is provided for connecting an optical sensor to detect the presence of objects between the doorways of system 10. A resistor 226 is connected between line 220 and a negative 15 volt supply. A capacitor 228 is connected in parallel with a resistor 230 between line 2220 and ground.

Potentiometers 232, 234, 236 and 238 are connected to the control module 192 to provide a balance control for the module outputs.

The A/B output from the phase driver 24 is transmitted through line 44 from the control module 192. The A output is transmitted through line 46 and the B output goes through line 48. Lines 44, 46 and 48 transmit the phasing signals to the power transistor circuit 32. Line 50 transmits the positive 24 volt power to the input regulator 276 of the power transister circuits 32.

Figure 6:
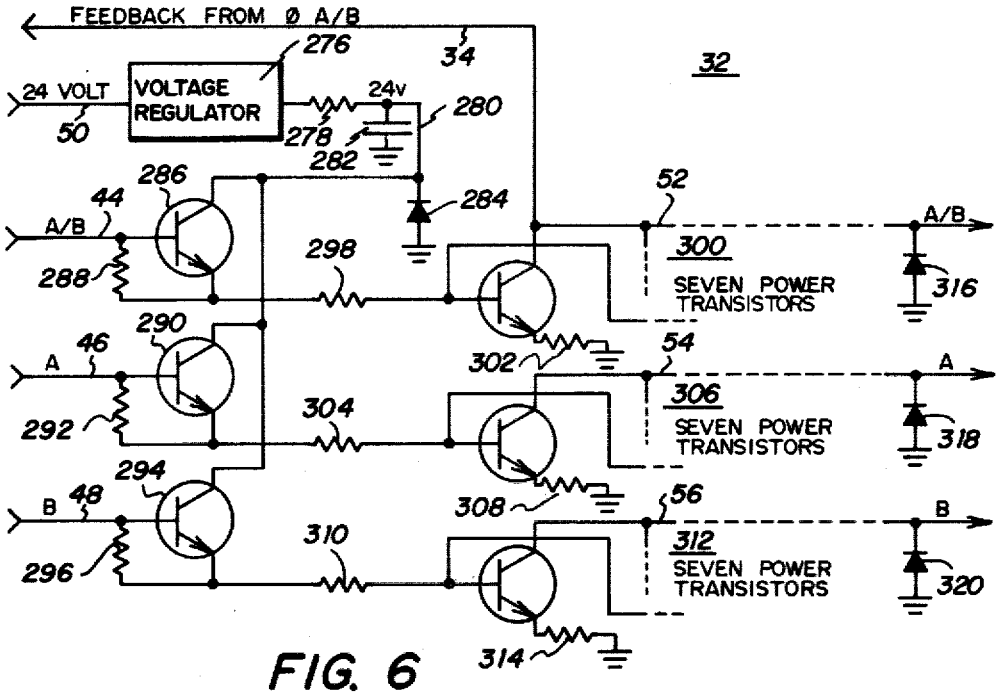
FIG. 6 is a detailed circuit diagram of the power transistor circuit shown in FIG. 1.

The power transistor circuit 32 is shown in detail in FIG. 6. The 24 volt line 50 from phase driver 24 is connected to a voltage regulator 276 the output of which is connected through a resistor 278 to a voltage node 280. The voltage on node 280 is a regulated 24 volt level. A filter capacitor 282 is connected between node 280 and ground. A diode 284 has a cathode terminal thereof connected to node 280 and the anode terminal thereof connected to ground.

Line 44, which transmits the A/B signal, is connected to the base terminal of a transistor 286 which has the collector terminal thereof connected to node 280. A resistor 288 is connected between the base and emitter terminals of transistor 286.

Line 46, which transmits the A signal, is connected to the base terminal of a transistor 290 which has the collector terminal thereof connected to node 280. A resistor 292 is connected between the base and emitter terminals of transistor 290.

The B signal is transmitted over line 48 which is connected to the base terminal of a transistor 294 which has the collector terminal thereof also connected to node 280. A resistor 296 is connected between the base and emitter terminals of transistor 294.

The emitter terminal of transistor 286 is connected through a resistor 298 to the base terminals of a collection of power transistors 300. Each of the power transistors 300 is provided with a load resistor such as 302 which is connected between ground and the emitter terminal of the corresponding transistor. The collector terminals of power transistors 300 are connected to line 52 for generating the A/B signal which is transmitted through the control and fuse panel 12 to the interrogation coils 30.

The emitter terminal of transistor 290 is connected through a resistor 304 to the base terminals of a collection of power transistors 306. Each of the transistors 306 is provided with a load resistance such as 308 which is connected between the emitter terminal of the corresponding transistor and ground. The collector terminals of the power transistors 306 are connected to line 54 for generating the A control signal which is transmitted through the control and fuse panel 12 to the interrogation coils 30.

The emitter terminal of transistor 294 is connected through a resistor 310 to the base terminals of a plurality of power transistors 312. Each of the power transistors 312 is provided with a load resistance such as 314 which is connected between the emitter terminal of the power transistor and ground. The collector terminals of transistors 312 are connected in common to line 56 for transmitting the B signal through the control and fuse panel 12 to the interrogation coils 30.

Seven power transistors are shown in each case but the number used can vary depending on the particular application.

Diodes 316, 318 and 320 are connected respectively to lines 52, 54 and 56 for protecting the power transistors connected to these lines.

Figure 7:
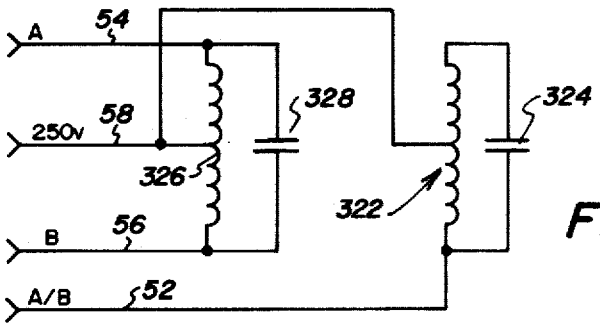
FIG. 7 is a circuit diagram of the interrogation coils shown in FIG. 1.

The circuit which includes the interrogation coils 30 is illustrated in FIG. 7. Line 52 is connected to a coil 322 which has a center tap connected to line 58 for receiving the 250 volt driving voltage. A capacitor 324 is connected to coil 322 to form a resonant circuit. Lines 54 and 56 are connected to a coil 326 which has the center tap also connected to line 58. A capacitor 328 is connected with coil 326 to form a resonant circuit. The coils 322 and 326 comprise the interrogation coils 30 which are shown in FIG. 1. Each of the two resonant circuits is adjusted to have a frequency of approximately 10 Khz.

The timing of the signals A/B on line 52, A on line 54 and B on line 56 is illustrated in FIG. 2.

Figure 8:
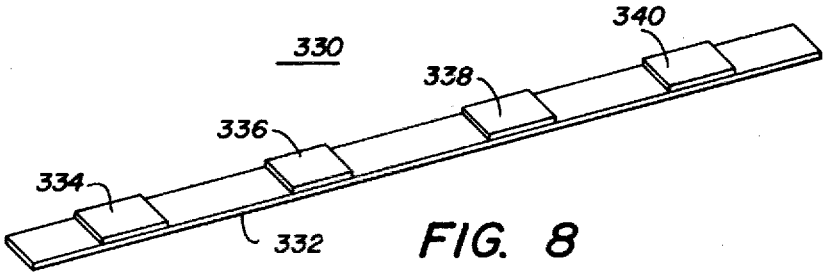
FIG. 8 is a perspective view of a marker strip for use which the present invention.

The marker which is used with the system 10 shown in FIG. 1 is illustrated in FIG. 8. Marker 330 comprises a signal strip 332 which is a relatively low coercivity material and a plurality of control elements 334, 336, 338 and 340 made of a higher coercivity material.

Figure 9:
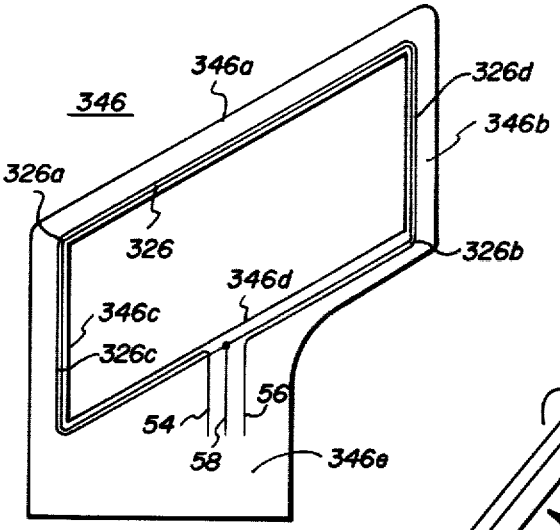
FIG. 9 is an elevation view of a detection gate together with an interrogation coil in accordance with the present invention.

A doorway unit which comprises a portion of the detection system of the present invention is illustrated in FIG. 9. The doorway 346 is essentially an inclined ramp structure having a trapezoidal shape. Doorway 346 has an upper inclined section 346*a*, a vertical upper section 346*b*, a vertical lower section 346*c*, a lower inclined segment 346 *d* and a supporting base 346*e*.

Coil 326 is wound in a trapezoidal shape within doorway 346. In the preferred shape of coil 326 the corners 326*a* and 326*b* are in a plane parallel to the floor which supports the doorway 346 and the coil segments 326*c* and 326*d* are perpendicular to the floor.

Doorway 346 is representative of the two or more doorways used in a given detection system. Doorway 346 is shown provided with coil 326 which is connected to center tap line 58, control line 54 and control line 56. The coil 326 comprises a plurality of turns of heavy gauge copper strap which is wound about the trapezoidal portion of doorway 346.

Figure 10:
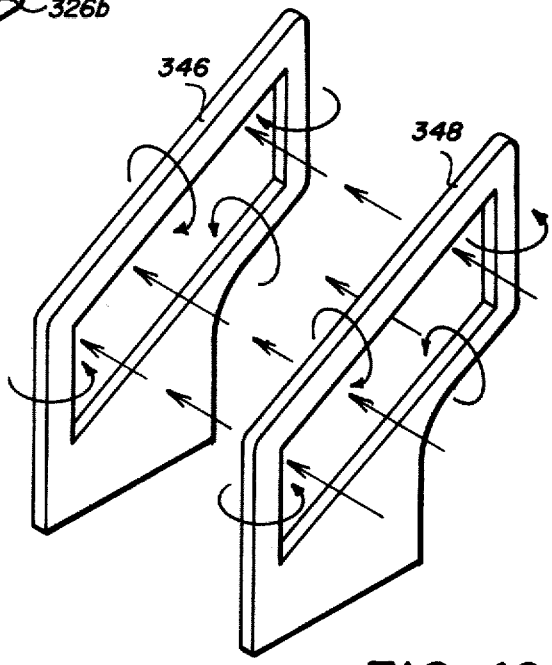
FIG. 10 is a perspective view showing the magnetic fields produced by the interrogation coils when the currents in the two coils are in-phase.
Figure 11:
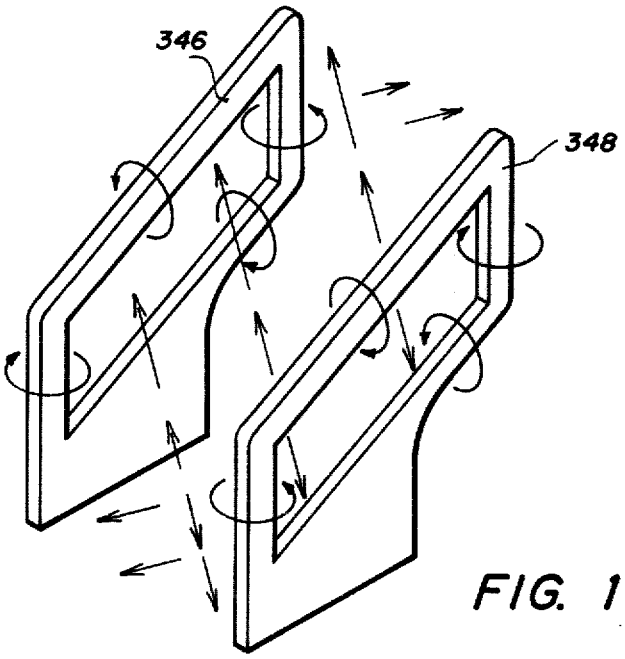
FIG. 11 is a perspective view of interrogation coils showing the magnetic field produced when the currents in the two coils are out-of-phase.

The magnetic fields produced by a pair of doorways used in conjunction with the detector of system 10 is illustrated in FIGS. 10 and 11. A two unit system comprising doorway 346 and a doorway 348 as shown in FIG. 10. Doorway 348 includes a coil such as 322 shown in FIG. 7. As noted above, detector systems can utilize more than two doorways. The detection field is the area between the doorways. The connection to the interrogation coil 326 within doorway 346 is such that the signal within coil 326 can be generated to have one of two phase relationships relative to the signal generated by the coil 322 in doorway 348. In FIG. 10 there is shown the magnetic fields, as illustrated by the arrows, wherein the signals produced by the coils in the two doorways are in phase. In this situation the magnetic fields add and reinforce each other to create a horizontal field extending between the doorways. Note that the fields produced by the vertical sections of the doorways cancel each other in the detection zone.

Referring to FIG. 11 the phase of the signal in coil 326 within doorway 346 has been shifted by 180° so that the resulting magnetic fields produced by the coils in doorways 346 and 348 are in opposition in the horizontal dimension but add in the vertical dimension. This produces a magnetic field which is tilted from the horizontal to the inclined orientation of the coils within doorways 346 and 348. The horizontal components of the magnetic fields produced by the coils within the doorways have opposite directions but equal amplitudes and are thereby cancelled. The vertical components reinforce and produce the inclined vertical field. The vertical end sections of the coils produce reinforcing horizontal field components.

The magnetic fields produced by the coils within doorways 346 and 348 function in such a manner as to practically eliminate the possibility that the marker 330 can be transported through the detection field between the doorways when the marker is in the activated state. In systems heretofore employing marker 330 the coils within the doorway system have been configured to be rectangular with either horizontal or vertical sections, circular or 25 vertically disposed ellipsoids.

With these previous configurations the marker 330 has been detectable when a substantial portion thereof is longitudinally aligned along either of two orthogonal axes. But, if the marker is introduced into the field of detection between such a pair of coils and the marker is oriented with its longitudinal axis along the remaining orthogonal axis, the system has not been able to detect the marker. A limitation such as this seriously degrades the effectiveness of a shoplifting prevention system. This is especially true if the marker can be detected and the potential shoplifter is aware of the null axis between the detection gates. The detection system of the present invention essentially eliminates this problem. By alternating the phase of the current in one of the coils, a magnetic field between the detection doorways 346 and 348 is caused to change from a horizontal orientation to essentially an inclined vertical. Note in FIG. 11 that when the current in the coils in the two doorways are in phase opposition that the vertical end segments of the interrogation coils produce reinforcing magnetic fields which are inclined essentially parallel with the floor surface supporting the doorways. Thus, the system of the present invention produces magnetic fields having three different orientations. These orientations are (1) horizontal in a transverse direction relative to the gates, (2) tilted from vertical by an angle corresponding to the incline of the ramps from the horizontal and (3) horizontal along the pathway of the gate formed by the doorways 346 and 348. It has been found that with such a configuration of magnetic fields, the marker 330, when activated, is caused to produce harmonic signals with almost every possible orientation in which it can be transported through the detection zone defined by doorways 346 and 348. When the marker 330 is transported through the detection zone of the present invention in the same manner that would prevent detection with the doorways heretofore in use, the marker is readily detected due to the magnetic fields generated by the present invention.

Although several embodiments of the invention have been illustrated in the accompanying drawings and described in the foregoing detailed description, it will be understood that the invention is not limited to the embodiments disclosed, but is capable of numerous rearrangements, modifications, and substitutions without departing from the scope of the invention.

I claim:

1. Apparatus for generating an alternating magnetic field in a detection zone to produce harmonic signals from a metallic strip therein, comprising:

a first and a second coil of conductive material, each of said coils configured to have a plurality of essentially linear segments, a first group of said segments having each one thereof oriented at an acute angle relative to horizontal and a second group of said segments each one thereof oriented essentially vertically, said first and said second coils spaced apart to form the detection zone therebetween, means for producing an alternating current in said first coil, and means for producing in said second coil an alternating current which alternates between being in-phase and out-of-phase with the current in said first coil.

2. The apparatus recited in claim 1 wherein the segments in said first group are each larger than the segments in said second group.

3. The apparatus recited in claim 1 wherein each of said coils is in the shape of a trapezoid.

4. The apparatus recited in claim 1 wherein said second group of segments comprises first and second segments, the lower end of the first segment and the upper end of a second segment in a plane which is parallel to a surface supporting said apparatus.

5. The apparatus recited in claim 1 wherein said means for producing an alternating current in said first coil comprises:

a DC voltage source connected to a center tap of said first coil, a capacitor connected to said first coil to create a resonant circuit, and means for periodically grounding a terminal of said first coil to cause said circuit to resonate.

6. Apparatus as recited in claim 1 wherein said means for producing an alternating current in said second coil comprises:

a DC voltage source connected to a center tap of said second coil, a capacitor connected to said second coil to create a resonant circuit, and means for grounding the terminals of said coil alternately to cause said circuit to resonate alternately in-phase then out-of-phase with the current in said first coil.

7. Apparatus for generating an alternating magnetic field in a detection zone to produce harmonic signals from a metallic strip therein, comprising:

a first and a second coil positioned parallel and spaced apart forming the detection zone therebetween, each of said coils trapezoidally shaped and having elongate sections thereof oriented at an acute angle from horizontal and the remaining sections thereof oriented vertically, means for producing an alternating current in said first coil, and means for producing in said second coil an alternating current which alternates between being in-phase and out-of-phase with the current in said first coil.

8. The apparatus recited in claim 7 wherein the upper end of a first of said vertically oriented sections and the lower end of a second of said vertically oriented sections are in a plane parallel to the surface supporting said coils.

9. A method for generating an alternating magnetic field in a detection zone to produce harmonic signals from a metallic strip therein, comprising the steps of:

positioning first and second coils in vertical planes and parallel at spaced apart locations to define the detection zone therebetween, each of said coils configured to have a plurality of essentially linear segments, a first group of said segments have each one thereof oriented at an acute angle relative to horizontal and a second group of said segments each one thereof oriented essentially vertically, producing an alternating current in said first coil, and producing in said second coil an alternating current which alternates between being in-phase and out-of-phase with the current in said first coil.

10. A method for generating an alternating magnetic field in a detection zone to produce harmonic signals from a metallic strip therein, comprising the steps of:

positioning first and second coils in vertical planes and parallel at spaced apart locations to define the detection zone therebetween, each of said coils being trapezoidally shaped and having a greater horizontal dimension than vertical dimensions, producing an alternating current in said first coil, and producing in said second coil an alternating current which alternates between being in-phase and out-of-phase with the current in said first coil.

11. A method for generating an alternating magnetic field in a detection zone to produce harmonic signals from a metallic strip therein, comprising the steps of:

positioning first and second coils vertically and spaced apart to define the detection zone therebetween, said coils having elongate segments thereof oriented at an acute angle relative to horizontal, driving in-phase alternating currents through said coils to produce aiding horizontal magnetic field from said coils during first periodic time periods, said aiding horizontal magnetic fields perpendicular to said coils, and driving out-of-phase alternating currents through said coils to produce opposing horizontal magnetic fields perpendicular to said coils and aiding magnetic fields parallel to the plane of said coils during second periodic time periods occurring alternately with said first periodic time periods.

* * * * *